US005706590A

United States Patent [19]

Candela et al.

[11] Patent Number: 5,706,590

[45] Date of Patent: Jan. 13, 1998

[54] SOLE FOR FOOTWEAR MADE AT LEAST PARTIALLY OF VEGETABLE FIBRES

[75] Inventors: Jose Vives Candela; Luis Ramon Candela Candela, both of Elche, Spain

[73] Assignee: Microlite, S.L., Crevillente, Spain

[21] Appl. No.: 715,247

[22] Filed: Sep. 19, 1996

Related U.S. Application Data

[63] Continuation of Ser. No. 393,276, Feb. 23, 1995, abandoned.

[30] Foreign Application Priority Data

Feb. 23, 1994 [EP] European Pat. Off. ..... 94500036

[51] Int. Cl.[6] ..... A43B 1/02; A43B 13/18

[52] U.S. Cl. ..... 36/84; 36/25 R; 36/25 A; 36/28; 139/408

[58] Field of Search ..... 36/25 A, 84, 3 B, 36/44, 3 R, 25 R; 12/146 B; 139/408, 409, 410, 413, 420 R

[56] References Cited

U.S. PATENT DOCUMENTS

| | | | |
|---|---|---|---|
| 321,577 | 7/1885 | Brown | 36/44 |
| 582,670 | 5/1897 | McWilliam | 36/44 |
| 1,012,825 | 12/1911 | Dornan | 139/413 |
| 1,106,986 | 8/1914 | Stuckl | 36/44 X |
| 1,923,169 | 8/1933 | Simmons | 36/44 |
| 2,266,631 | 12/1941 | Francis, Jr. | 139/420 X |
| 2,343,390 | 3/1944 | Ushakoff | 36/55 X |
| 2,467,821 | 4/1949 | Gregg | 36/25 A |
| 2,803,268 | 8/1957 | MacIntrye | 139/410 |
| 2,924,252 | 2/1960 | Baron | 139/413 X |
| 3,293,103 | 12/1966 | Georgii et al. | 139/410 X |
| 3,393,115 | 7/1968 | Hainsworth et al. | 139/408 |
| 4,107,371 | 8/1978 | Dean | 139/420 R X |
| 4,724,183 | 2/1988 | Heiman | 139/420 R X |
| 4,846,230 | 7/1989 | Mock et al. | 139/420 R X |

FOREIGN PATENT DOCUMENTS

| | | | |
|---|---|---|---|
| 0627878 | 10/1932 | Germany . | |
| 0755705 | 8/1956 | United Kingdom | 36/25 A |

*Primary Examiner*—Ted Kavanaugh
*Attorney, Agent, or Firm*—Bacon & Thomas

[57] ABSTRACT

A sole for footwear is formed from upper and lower textile base sheets that are joined by a binder. Each of the base sheets is formed from a weft that is interweaved with a warp. The weft and the binder are made of a vegetable fiber and the warp is made of a high tensile strength fiber.

4 Claims, 3 Drawing Sheets

SOLE FOR FOOTWEAR MADE AT LEAST PARTIALLY OF VEGETABLE FIBRES

This application is a continuation of application Ser. No. 08/393,276 filed Feb. 23, 1995 now abandoned.

BACKGROUND OF THE INVENTION

1. Field of the Invention

The invention refers to a sole for footwear made of vegetable fibre and of textile constitution, which constitutes a comfortable and hygienic foothold base, since it absorbs and eliminates the perspiration and favors the movement of the muscles and articulations, giving the foot freedom of movement and acting as a cushion.

2. Discussion of the Art

The soles for footwear used at present are chosen depending on the rigidity, flexibility and look required for their future use. These characteristics determine the material and design of these soles.

The soles made of vegetable fibre, as the rope-sole sandal, for example, are characterized by an easy perspiration due to the properties of the fibre.

A sole of this kind is made out of trusses of fibres plaited to form a flat surface. Then they are winded until they adapt the shape of the sole, so that the plait forms a sole, reinforced on the sides by a sewing that confers rigidity to the resulting unit.

By this procedure we obtain a sole that can be symmetrical and therefore used indistinctly by both feet, or it can be adapted to the anatomical shape of the right or left foot.

The manufacturing process of this kind of sole can be made hand or with the aid of machinery to carry out the operations described.

The structure obtained by the usual procedure has a very low resistance to deformation as a consequence of the low consistency of the winding; the continuous use produces a deterioration and weakening of the sole.

The manufacturing of the sole takes a lot of time because it is necessary to go through several phases until the final product is obtained, and as a result of this there are high costs of realization and physical limitations, as the increasing fatigue, that reduce the production capacity as the day goes on.

It also has to be taken into account that it is very difficult to wind the plaits in order to obtain the different sizes.

One of the oldest kinds of footwear is the rope-soled sandal, the most humble and yet the most expensive, due to the difficulties to find the materials to make the sole.

These materials go from the jute, more expensive, to the esparto, the cheapest one; they are cultivated in poor soils and require a great amount of labor, because they are harvested and shredded by hand.

The jute is obtained mainly in India and is used to make cords, ropes, thread to weave clothes for sacks and as a base for sheets made out of synthetic materials and which require a cheap reinforcement.

The present invention uses this kind of vegetable fibres, providing a new market for these materials apart from the exiting ones, that are not able to absorb the production capacity of this sector. This greater demand will have a repercussion in those zones where these fibres are produced, generating more wealth and improving the working conditions.

The sole proposed by the invention uses vegetable fibres like the jute, which has some advantageous characteristics as flexibility, cushioning capacity and easy perspiration, properties that provide comfort and freedom of movement to muscles and articulations of the foot as well as a better circulation of the blood, improving the psychophysical conditions of the user.

SUMMARY OF THE INVENTION

The invention comprises a sole for footwear formed by two base textile sheets joined by a binder, forming a compact and resistant unit, so that the sole deteriorates less with the continuous use.

Each sheet is formed by a weft, made out of a material like jute or a vegetable fibre similar in cost and properties, and by a warp of a material with a great consistency and tensile strength, like cotton staple together or not with jute, hemp, flax, etc.

The binder of the two sheets contains the material with tensile strength along the sole. The vegetable fibre joins the upper and lower sheets with double or triple binding points, as if it were an uncut carpet.

The sole obtained has a great consistency that prevents the displacement of the sheets and keeps them together.

The quantity of each material used can vary, although a greater amount of jute is required in the sheets and in the binder.

The shape given to the sole can be symmetrical, and therefore valid for both feet indistinctly, or it can be adapted to the shape of each foot. The size and shape of the sole are obtained by means of a die-cut, carried out mechanically with a cutting punch with the same shape as the desired sole. This is very advantageous when we want to obtain soles of different sizes, since we only have to change the cutting punch.

In order to obtain the soles for both feet, only one cutting punch is needed, since just by rotating it we can obtain right and left soles.

DESCRIPTION OF THE DRAWINGS

In order to complete the description of the invention and to provide a better understanding of its characteristics, there is a set of drawings attached to this document, which represent with an illustrative and not limitative character the following.

DETAILED DESCRIPTION OF THE PREFERRED EMBODIMENTS

Figure 1:
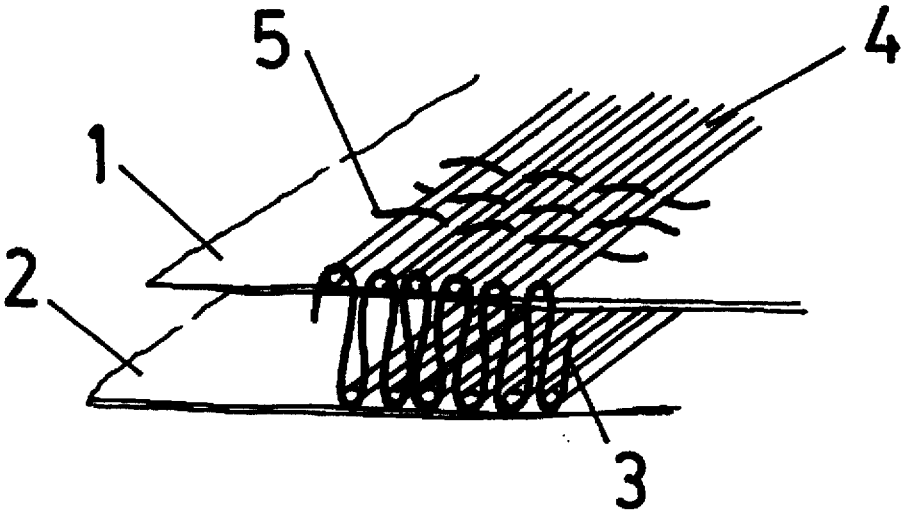
FIG. 1: A general perspective of the compound sole obtained with the different elements that constitute it.

As we can see in FIG. 1, the sole for footwear is constituted by two woven base sheets 1–2, joined by a binder 3, each one formed by a weft 4 and a warp 5.

The warp 5 is made of cotton yarns in groups of three separated by the yarns of binder 3.

Each cotton yarn 5 passes under the jute yarns 4 and then over one of these yarns 4, repeating this sequence all along the weft. In each of these groups of three yarns, the two yarns that are in the extremes have the same run, but the one in the middle has a different run, passing under the jute yarns 4 when the extreme yarns of the group of three pass over them and vice versa. The warp 5 has a quantity of cotton staple of 3 to 20% with respect to the jute.

Figure 3:
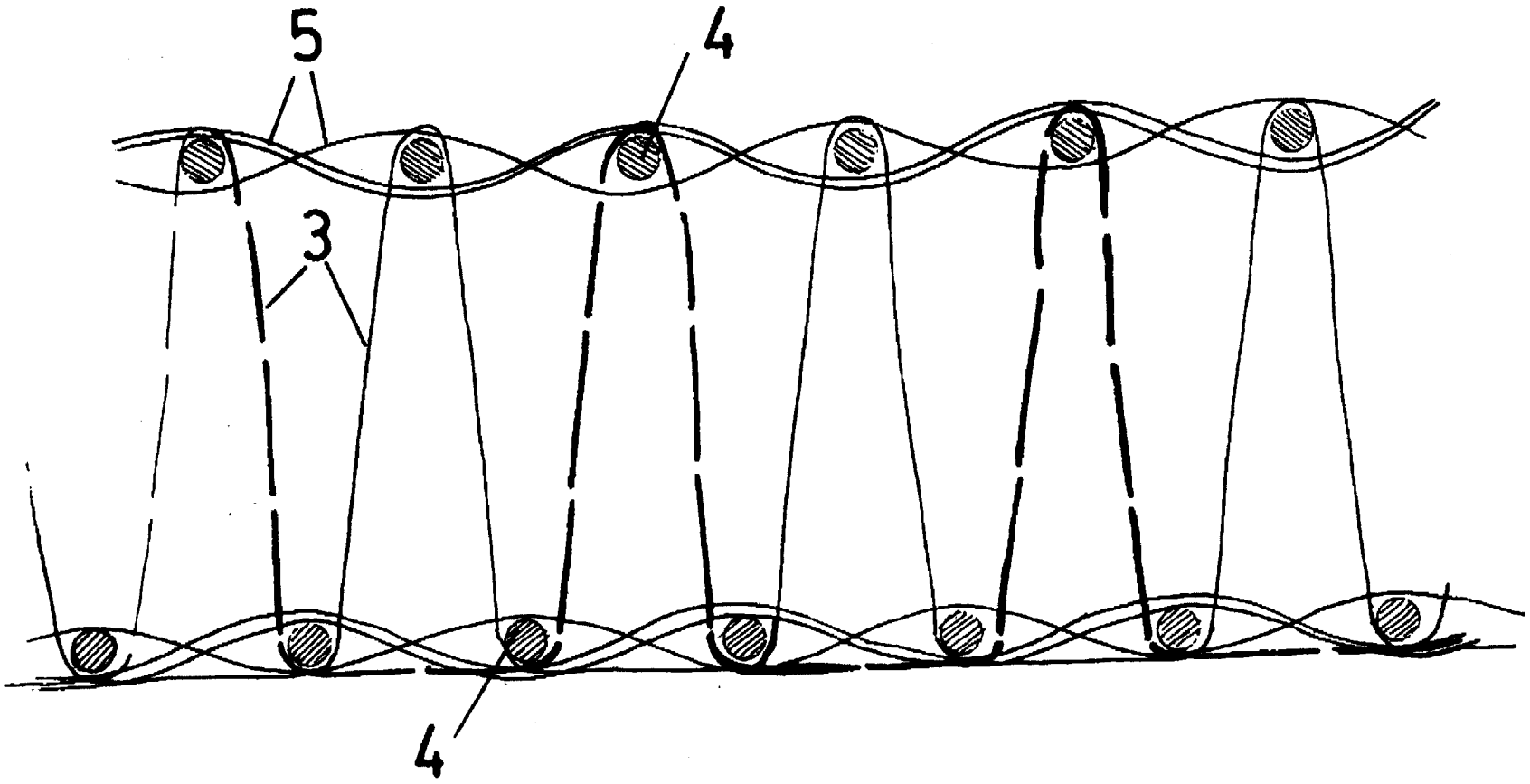
FIG. 3: A cross-sectional view of the sole with double binding points.
Figure 4:
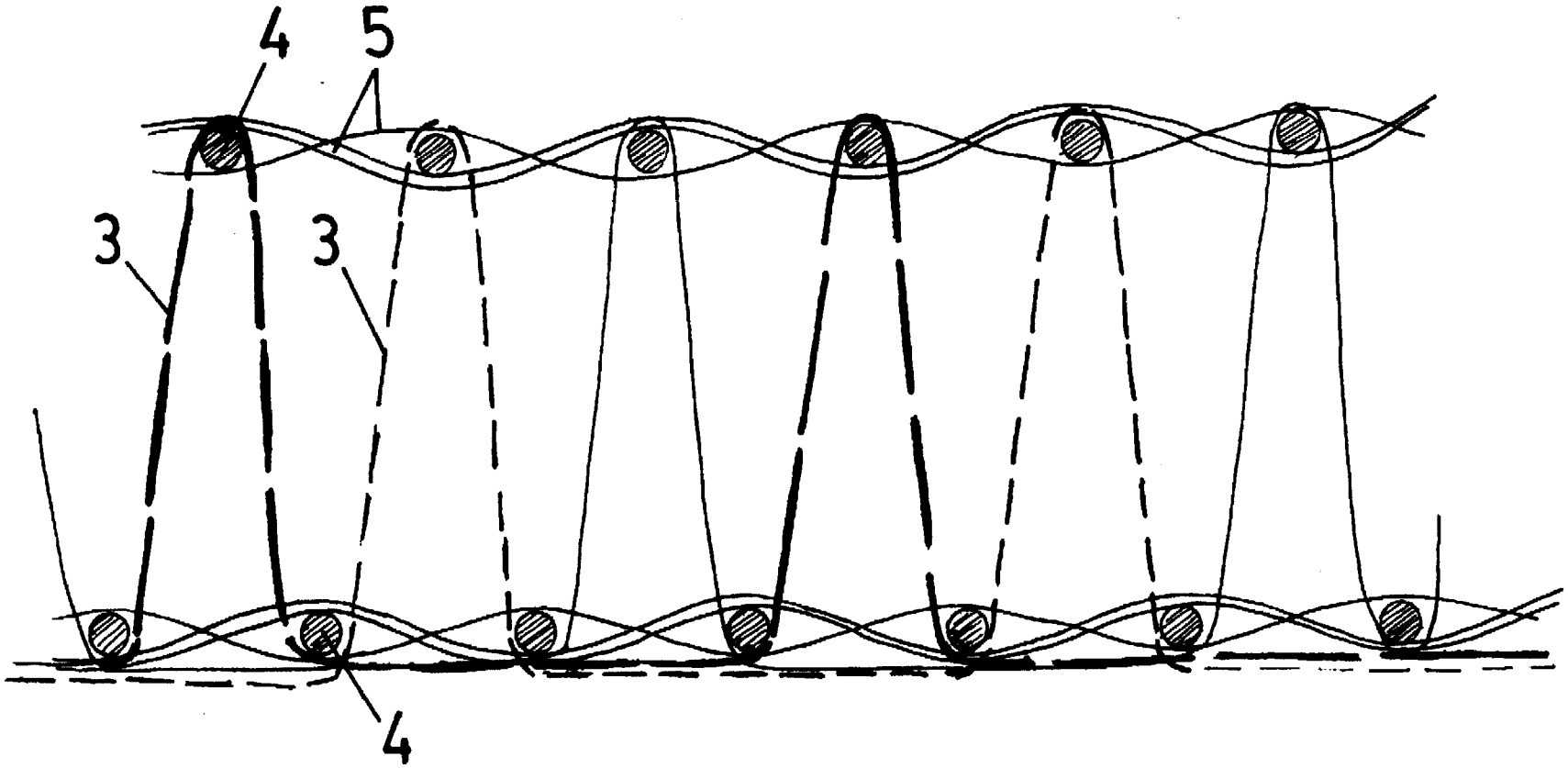
FIG. 4: A cross-sectional view of the sole with triple binding points.

The binder of these two sheets is constituted by a jute weft 3, forming binding points. The binder obtained is like an uncut carpet between two spaced parallel woven sheets and can join the two sheets with double or triple binding points as shown in FIGS. 3 and 4 respectively.

The realization of the two sheets constituted as described before is made by mechanical means, that is, conventional looms, and it only requires a knowledge of the textile techniques.

Figure 2:
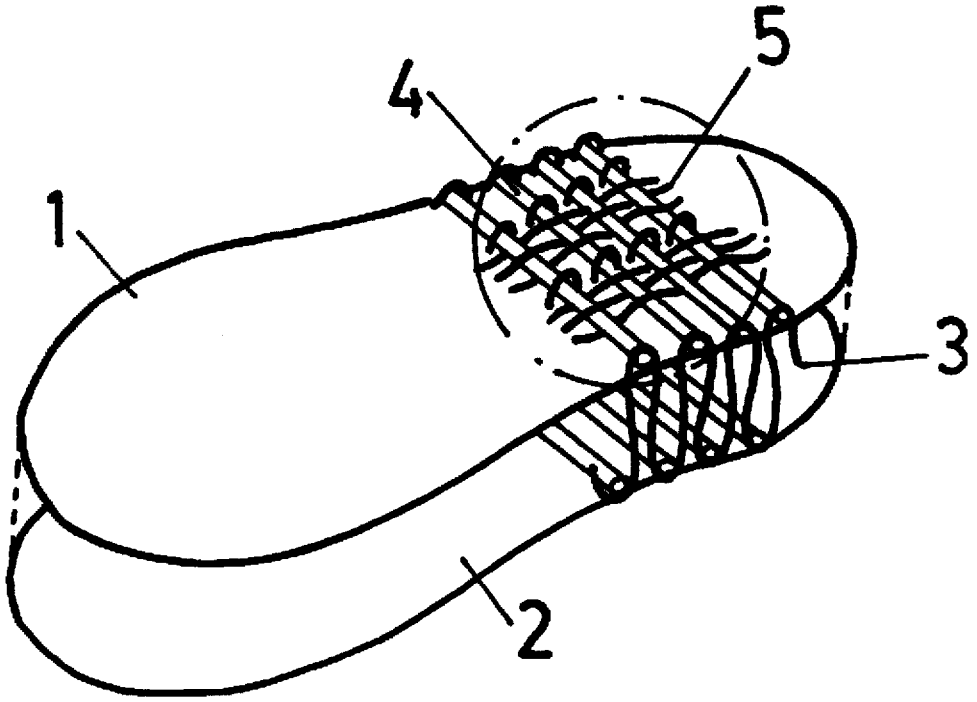
FIG. 2: A general perspective of the sole obtained by means of a diecut.

Once these sheets have been obtained, they are cut with a cutting punch, obtaining a sole as represented in FIG. 2.

The sole can be deformed with a press in order to obtain anatomical shapes. This sole can be integrated in different kinds of footwear, constituting the base for inner soles and/or rubber soles for example.

Although the part in contact with the ground can have any kind of reinforcement to improve the resistance, the sole does not lose the capacity of perspiration and absorption.

We claim:

1. A sole for footwear comprising:

first and second textile base sheets each of which is sized to conform to a foot of a user of the footwear such that said first and second base sheets are adapted to serve as a foothold base, each of said first and second base sheets being formed by a weft that is interweaved with a warp, said weft being made of a vegetable fibre and said warp being made of a fibre having a high tensile strength; and a binder joining said first and second base sheets with said first base sheet being located above and spaced from said second base sheet, said binder spanning said sheets, being made of vegetable fibre and extending along the base sheets in the same direction as the base sheet warp.

2. The sole for footwear according to claim 1, wherein said binder joins said first and second base sheets through double binding points with said weft.

3. The sole for footwear according to claim 1, wherein said binder joins said first and second base sheets through triple binding points with said weft.

4. The sole for footwear according to claim 1, wherein said binder is formed from jute.

* * * * *